US011587407B2

(12) United States Patent
Hanna

(10) Patent No.: US 11,587,407 B2
(45) Date of Patent: Feb. 21, 2023

(54) INTERACTIVE SKILL CHALLENGE COIN FUNNEL SPINNING WELL

(71) Applicant: Michael Hanna, Lenexa, KS (US)

(72) Inventor: Michael Hanna, Lenexa, KS (US)

( * ) Notice: Subject to any disclaimer, the term of this patent is extended or adjusted under 35 U.S.C. 154(b) by 224 days.

(21) Appl. No.: 17/014,552

(22) Filed: Sep. 8, 2020

(65) Prior Publication Data

US 2021/0074129 A1 Mar. 11, 2021

Related U.S. Application Data

(60) Provisional application No. 62/897,068, filed on Sep. 6, 2019.

(51) Int. Cl.
*G07F 17/32* (2006.01)
*A63F 7/02* (2006.01)

(52) U.S. Cl.
CPC ..... *G07F 17/3297* (2013.01); *A63F 7/02* (2013.01); *G07F 17/3213* (2013.01)

(58) Field of Classification Search
CPC ..... G07F 17/3213; G07F 17/3297
See application file for complete search history.

(56) References Cited

U.S. PATENT DOCUMENTS 3,479,033 A * 11/1969 Crisafulli ..... A63F 7/386 273/110
3,764,134 A * 10/1973 Reinertsen ..... A63F 9/26 273/287
3,822,885 A * 7/1974 Domka ..... A63F 7/386 273/110
3,844,562 A * 10/1974 Foley ..... A63F 7/386 273/110
4,297,807 A * 11/1981 Buettner ..... A63F 9/02 273/340
4,762,512 A * 8/1988 Divnick ..... A63F 7/00 206/0.8
4,871,055 A * 10/1989 Poythress ..... G07F 17/3213 194/344
5,435,555 A * 7/1995 Fuhrer ..... A63F 7/386 273/110
5,607,155 A * 3/1997 Campbell ..... A63F 7/386 273/113
5,888,115 A * 3/1999 Shoemaker, Jr .... G07F 17/3297 446/168

(Continued)

*Primary Examiner* — Milap Shah
*Assistant Examiner* — Jason Pinheiro
(74) *Attorney, Agent, or Firm* — Law Office of Mark Brown, LLC; Mark E. Brown

(57) ABSTRACT

A coin funnel spinning well device includes upper and lower sections connected by a midsection suspension system configured for accommodating oscillating movement in three dimensions between the sections. The upper section includes an observation dome mounted on a funnel with a lower funnel discharge. A coin launch assembly is mounted in the observation dome and receives coins through a coin insert opening in the observation dome. A pair of handles are mounted on opposite sides of the upper section and enable an operator to manipulate movement of the upper section to maintain a coin on a spiral trajectory. The coin funnel spinning well device can be automated with a computerized control system for controlling Internet access, lighting, coin sensing, timer, and input and output device functions.

1 Claim, 10 Drawing Sheets

(56) References Cited

U.S. PATENT DOCUMENTS

| | | | | |
|---|---|---|---|---|
| 5,911,299 | A * | 6/1999 | Aspnes | G07F 1/04 194/344 |
| 6,092,807 | A * | 7/2000 | Yu | G07F 17/3297 273/138.2 |
| 6,485,018 | B2 * | 11/2002 | Lorenz | A63F 7/386 273/110 |
| 6,619,962 | B1 * | 9/2003 | Gubitosi | G09B 19/0038 434/258 |
| 7,311,304 | B1 * | 12/2007 | Kelly | A63F 7/0005 273/138.3 |
| 7,559,552 | B2 * | 7/2009 | Shoemaker, Jr. | G07F 17/3297 273/138.3 |
| 7,704,118 | B2 * | 4/2010 | Divnick | G07F 17/3297 453/18 |
| 9,307,812 | B2 * | 4/2016 | Knox, Jr. | A45C 1/12 |
| 2008/0242184 | A1 * | 10/2008 | Divnick | A63F 7/2409 446/168 |

* cited by examiner

INTERACTIVE SKILL CHALLENGE COIN FUNNEL SPINNING WELL

CROSS-REFERENCE TO RELATED APPLICATION

This application claims priority in U.S. Provisional Patent Application No. 62/897,068, filed Sep. 6, 2020, which is incorporated herein by reference.

BACKGROUND OF THE INVENTION

1. Field of the Invention

The present invention relates generally to an interactive skill challenge apparatus and method for use thereof, and more specifically to a moveable coin funnel wishing well apparatus.

2. Description of the Related Art

Various gaming and entertainment devices are available with features and functions for interacting with the participants. For example, conventional pinball machines accommodated competition among multiple players with score-keeping functions for determining game outcomes. Such games typically promoted hand-eye coordination skills.

More recently, video games have become prevalent with a wide variety of formats and themes for broadly appealing to users with various interests. Video game inputs can be accomplished with computer mice, keyboards, joysticks and other input devices. In addition to personal entertainment, competitions among remote players can be accommodated.

The coin funnel spinning well of the present invention appeals to similar interests, and further enables fundraising whereby coins inserted for play can be collected and donated or retained by the game device owners.

Heretofore there has not been available a device for interactive play and competition with the advantages and features of the present invention.

SUMMARY OF THE INVENTION

In the practice of an aspect or embodiment of the present invention, an interactive coin funnel spinning well device is provided which receives coins at an upper section, guides them along a spiral trajectory, and collects them in a secure coin receptacle. The upper section includes a transparent dome for observing the coins and a secure coin receptacle. A lower section is configured for placement on a flat surface and connects to the upper section via a midsection suspension system, which is manipulated by an operator grasping handles on opposite sides of the upper section.

Alternative aspects or embodiments of the present invention can include coin-chasing lights, customer attraction lights, timers and a microprocessor for automating various functions and interactively communicating with, for example, the Internet via a cloud application.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
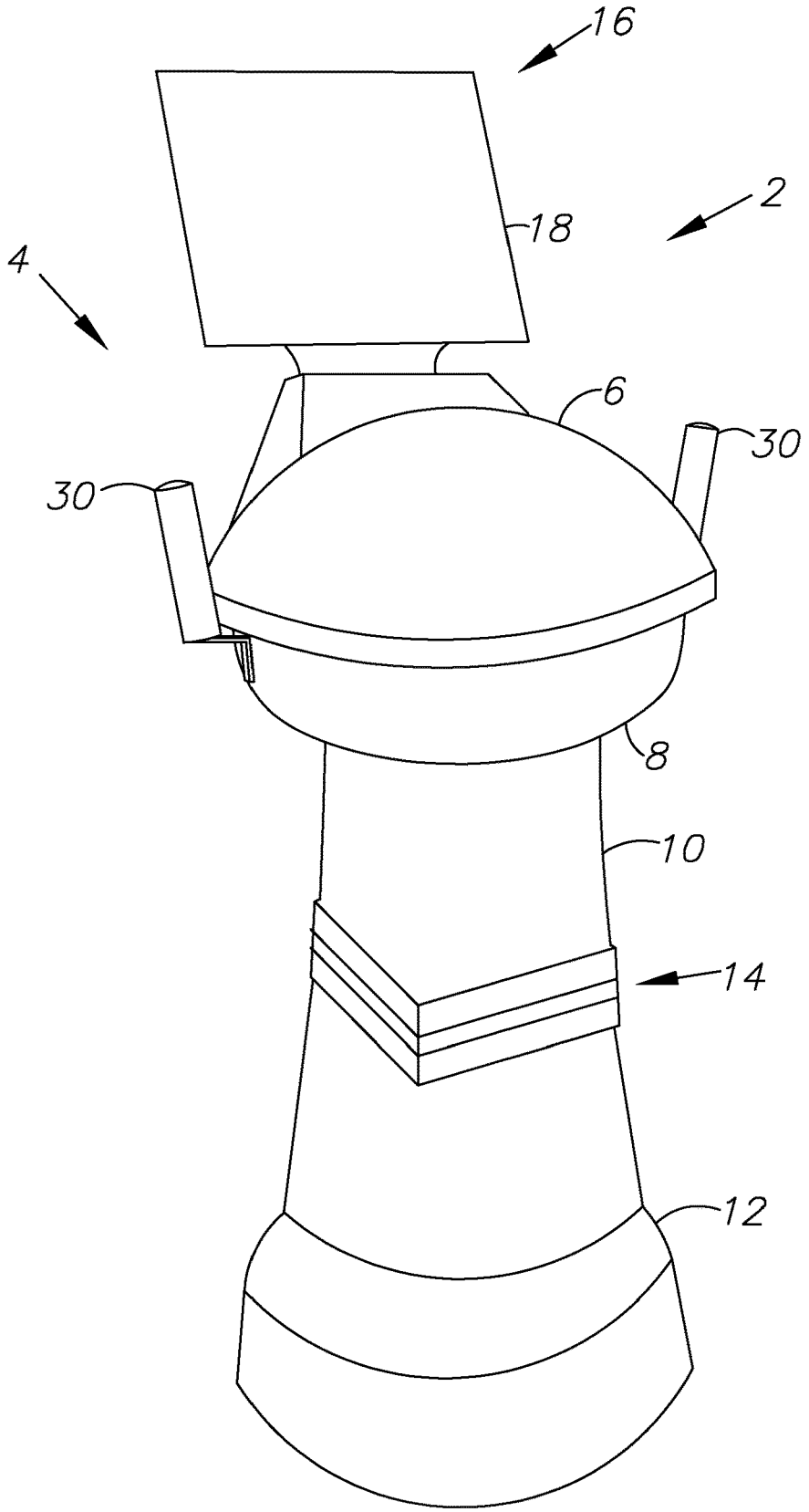
FIG. 1 is a front, elevational view of an interactive coin funnel spinning well embodying an aspect of the present invention.
Figure 2:
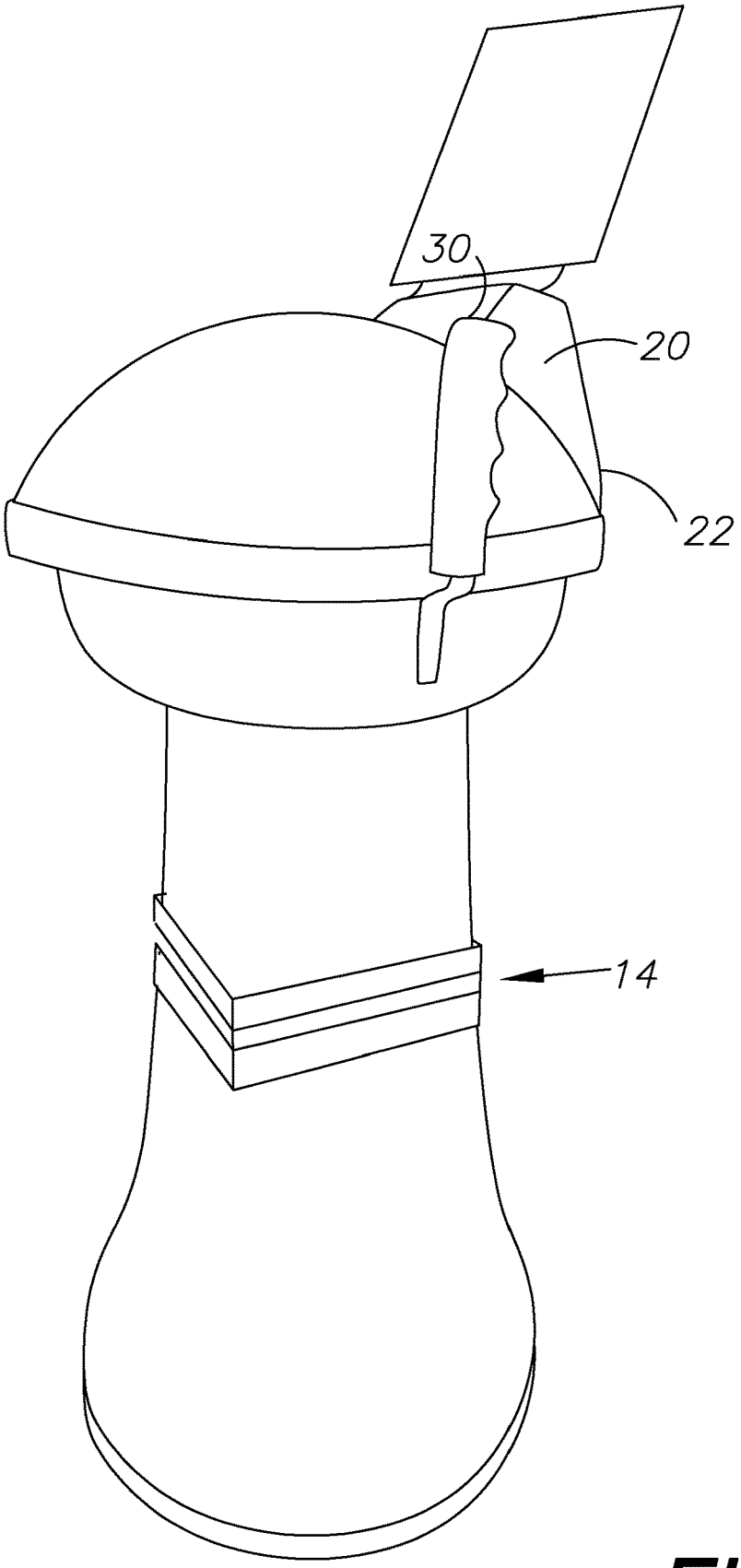
FIG. 2 is a side elevational view thereof.
Figure 3:
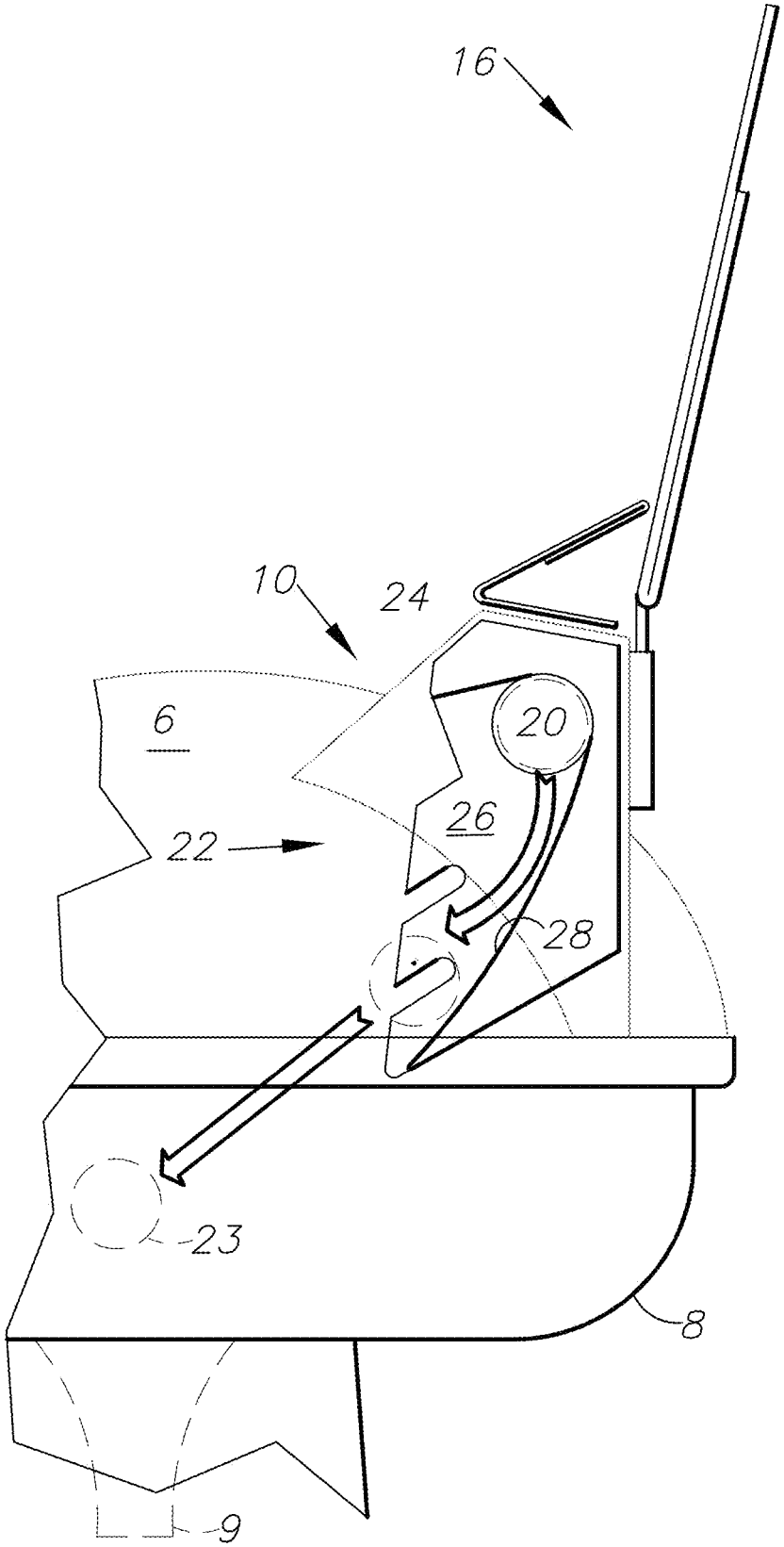
FIG. 3 is an enlarged, side elevational view, particularly showing a coin launch assembly.
Figure 4:
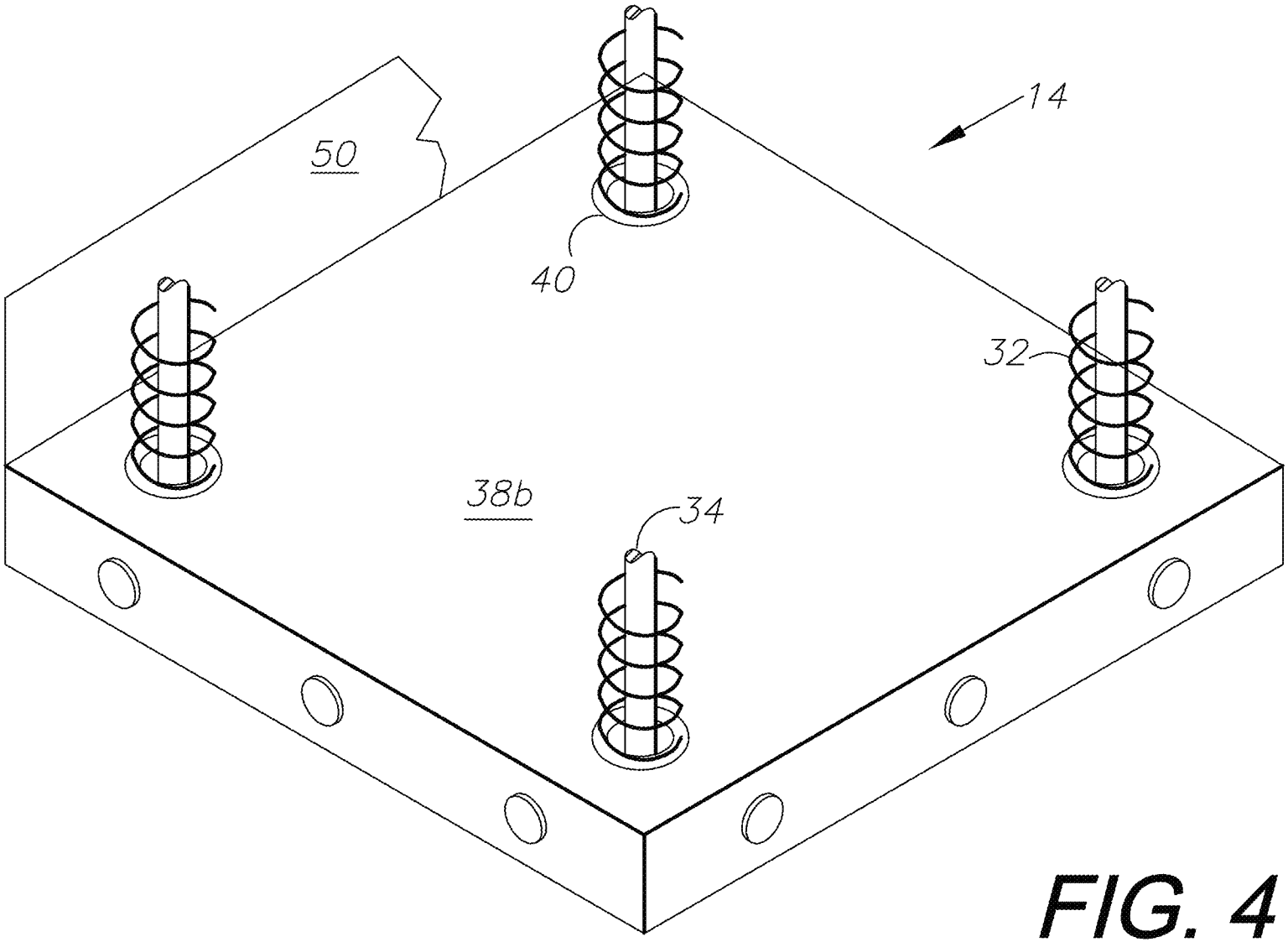
FIG. 4 is a perspective view of a lower portion of a midsection suspension system.
Figure 5:
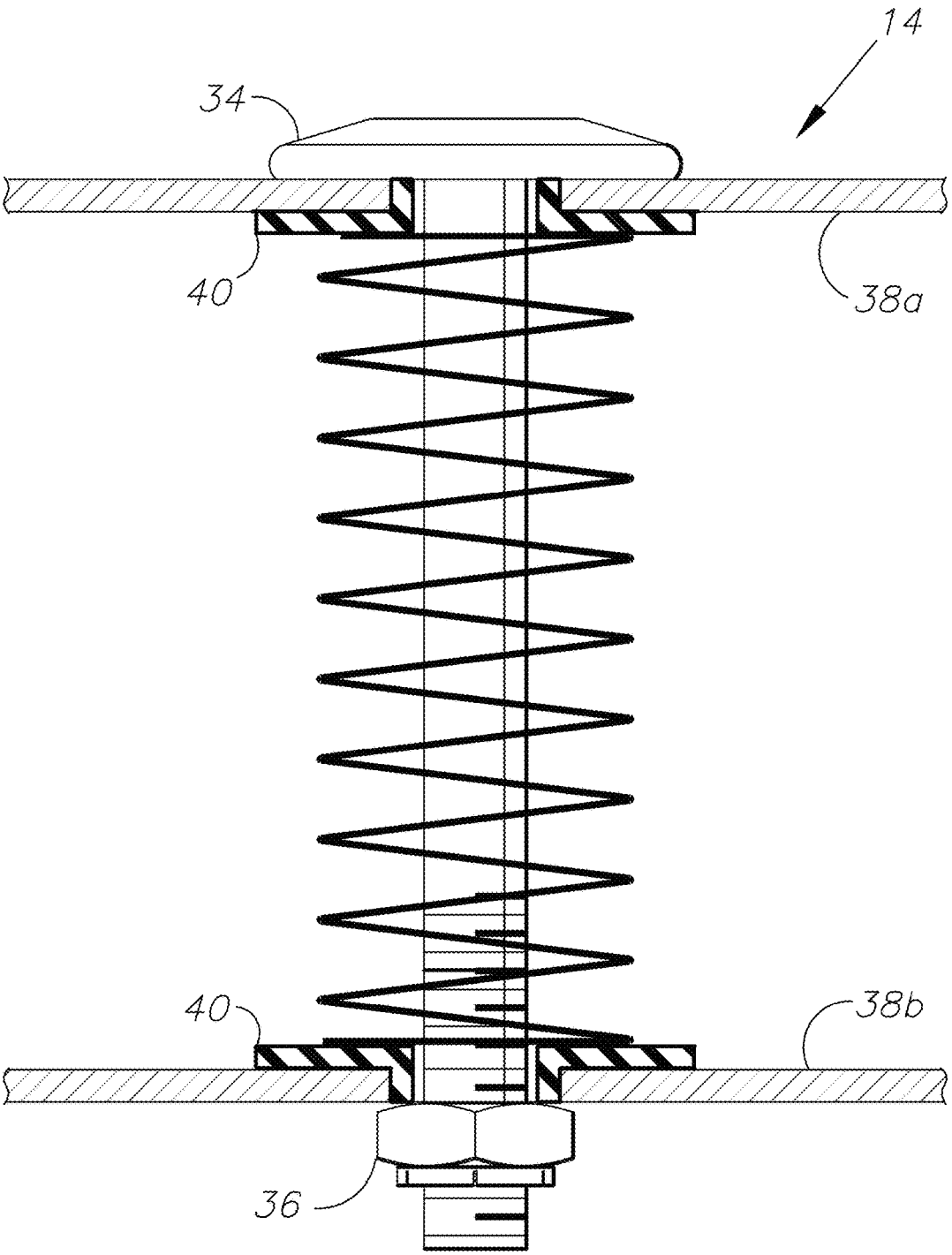
FIG. 5 is an enlarged, cross-sectional view of the suspension system, particularly showing a spring mounted between grommets embedded in upper and lower section panels.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right, and left refer to the invention as orientated in the view being referred to. The words "inwardly" and "outwardly" refer to directions toward and away from, respectively, the geometric center of the aspect being described and designated parts thereof. Said terminology will include the words specifically mentioned, derivatives thereof and words of similar meaning.

II. Coin Funnel Spinning Well Device Aspect or Embodiment

Referring to the drawings more detail, the reference numeral 2 generally designates a coin funnel spinning well device embodying a preferred aspect or embodiment of the present invention. The device generally comprises an upper section 4 with an observation dome 6 mounted on top of a funnel 8 connected to a coin receiver 10. The upper section 4 is flexibly mounted on a lower section or base 12 by a midsection suspension system 14.

The upper section 4 includes a plaque holder 16 configured for displaying a plaque 18, which can include sponsorship information, instructions, promotion and other content for attracting participants. A pair of coin openings 20 on both sides of the observation dome 6 lead to coin launch assemblies 22, whereby the device 2 can be played from either side or both for a higher challenge level. Each coin launch assembly 22 includes a guide panel 24 with a shallow recess 26 slightly deeper than the thickness of a coin 23. The recess includes a downwardly-and-forwardly sloping edge 28, which conveys a downwardly-rolling coin forwardly to initiate a spiral trajectory traversing the observation dome 6 and the funnel 8. Guide handles 30 are provided on both sides of the upper section 6 whereby an operator can guide and prolong the coin trajectory.

The mid-section suspension system 14 accommodates a range of motion to maintain coins "in play" in the upper section 4 until they fall through a funnel exit 9 into the coin receiver 10. The mid-section suspension system 14 generally comprises four helical compression springs 32, each receiving a connecting bolt 34 mounting a locking nut 36. The connecting bolts 34 connect upper and lower midsection suspension panels 38*a,b*, and are received therein by plastic (e.g., polyethylene, polyvinyl chloride (PVC), etc.) bushings 40, which provide scratch-resistance protection between the ends of the springs 32 and the panels 38 a, b. Moreover, the bushings tend to quiet the oscillating movements of the upper section 4 relative to the lower section 12. Safety panels 50 are mounted on all sides of the mid-section suspension system 14 to block operators from inserting their fingers between the upper and lower midsection suspension panels 38*a,b*, where they could be caught between the oscillating upper section 4 and the lower section 12.

Figure 6:
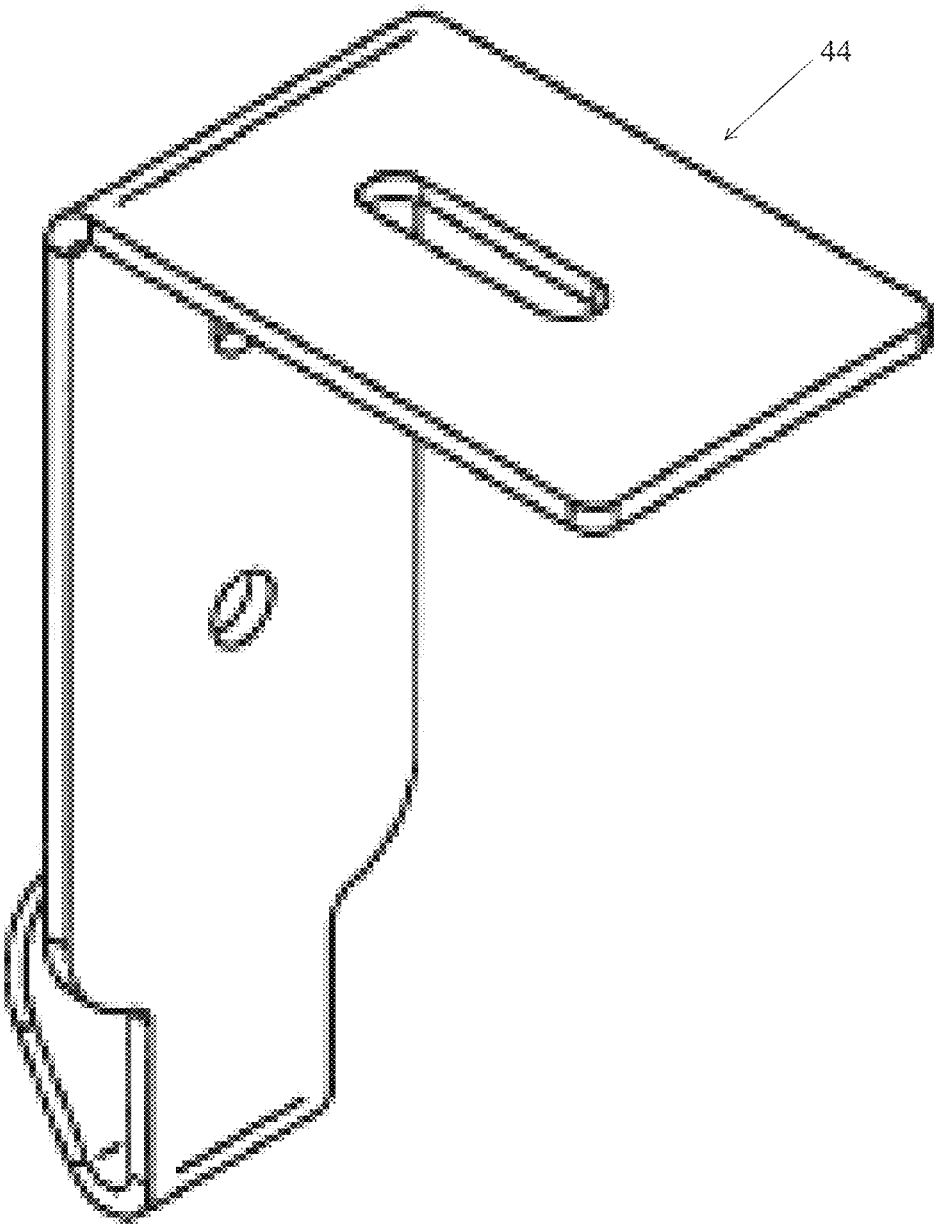
FIG. 6 is a perspective view of a clip of a hasp assembly for securing the dome and funnel in place on the upper section.
Figure 7:
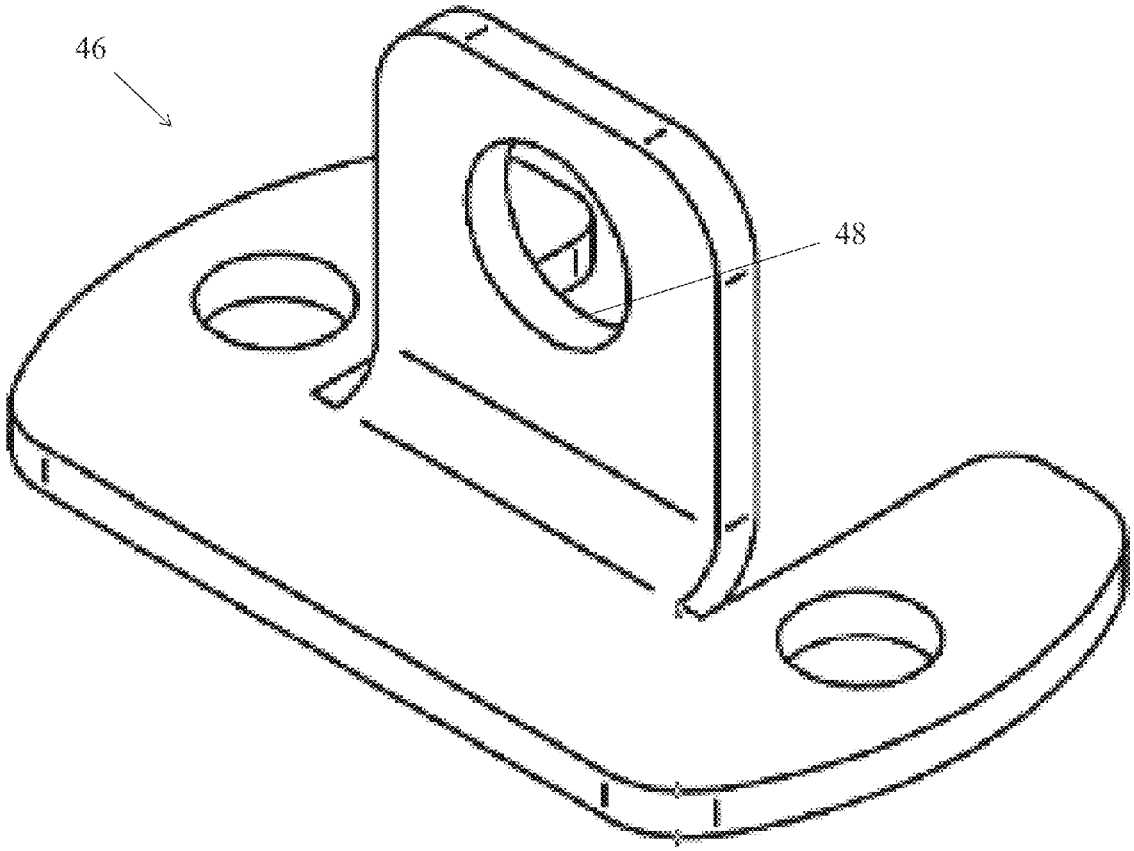
FIG. 7 is an enlarged, perspective view of a tab of the hasp assembly.
Figure 8:
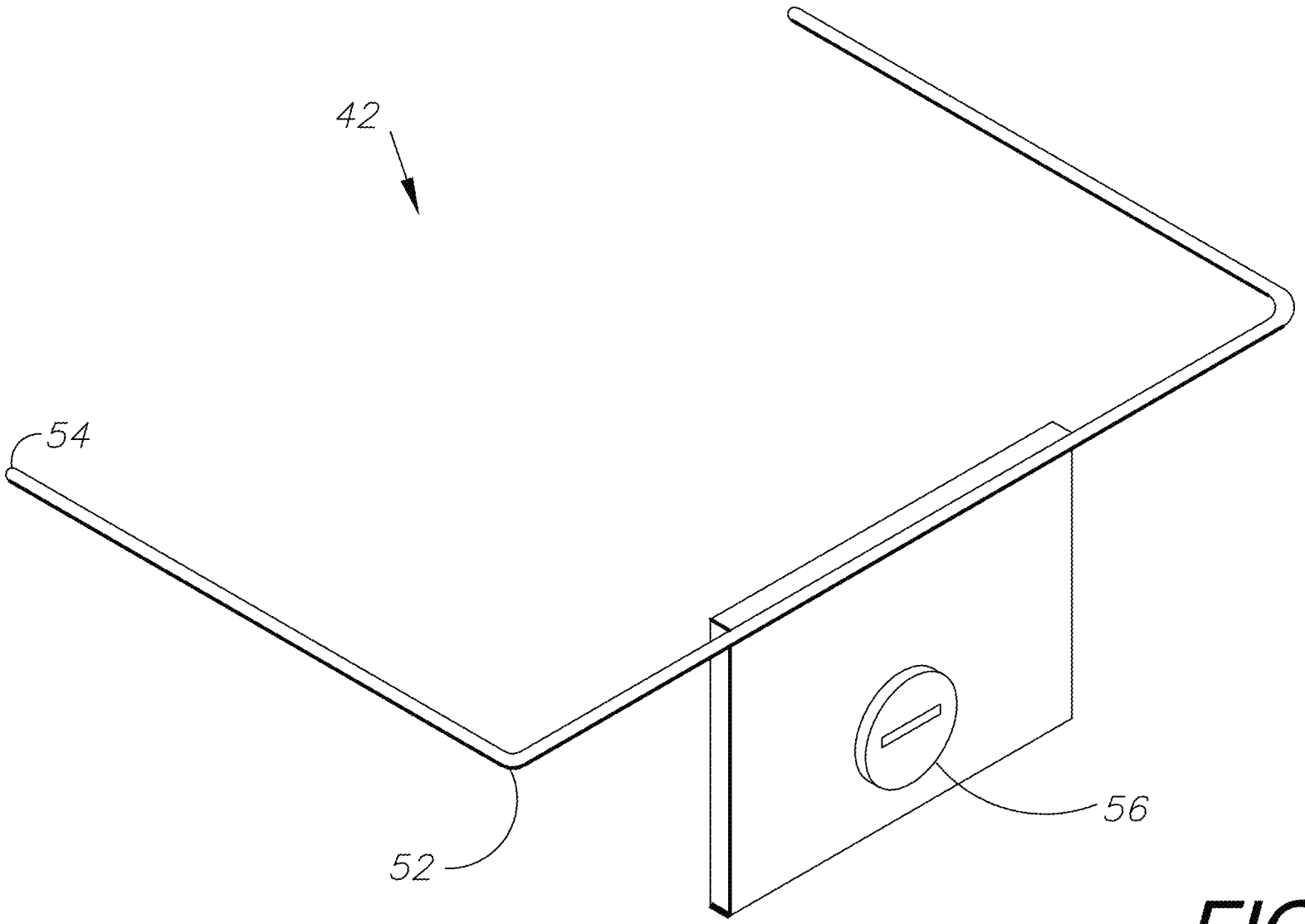
FIG. 8 is a perspective view of a locking hasp of the hasp assembly.
Figure 9:
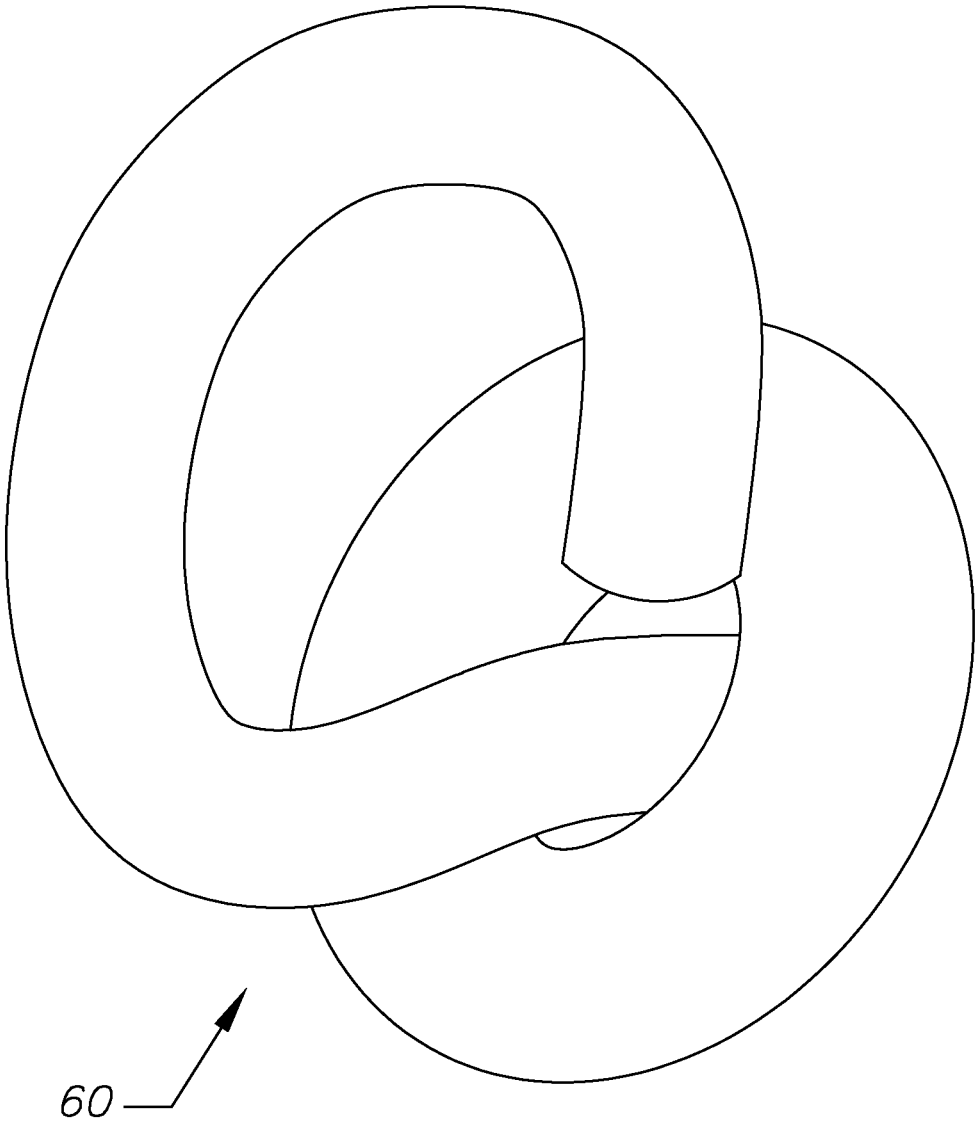
FIG. 9 is a perspective view of a security eye mounted on the lower section.

For security, the coin receiver 10 can be locked to the funnel 8 by a hasp assembly 42, including a pair of clip-hooks 44 (FIG. 6) configured for suspending a coin bag within the coin receiver 10 and receiving tabs 46 mounted on and depending downwardly from the funnel 8. The tabs 46 include receivers 48. A locking hasp 52 (FIG. 8) includes a U-shaped bail 54 with legs extending through the tab receivers 48 with the locking hasp 52 in place. The locking hasp also includes a lock assembly 56 mounted on the bail 54 and configured for interacting with a lock opening, which can be formed in the back of the coin receiver 10.

The lower section or base 12 includes a rearwardly-extending security eye bolt 60, which is adapted for receiving a security chain or cable for locking the device 2 in place.

The lower section 12 can receive ballast for stabilizing the device 2 in operation. Such ballast, e.g., bags of sand, can be inserted through a lower section access.

Figure 10:
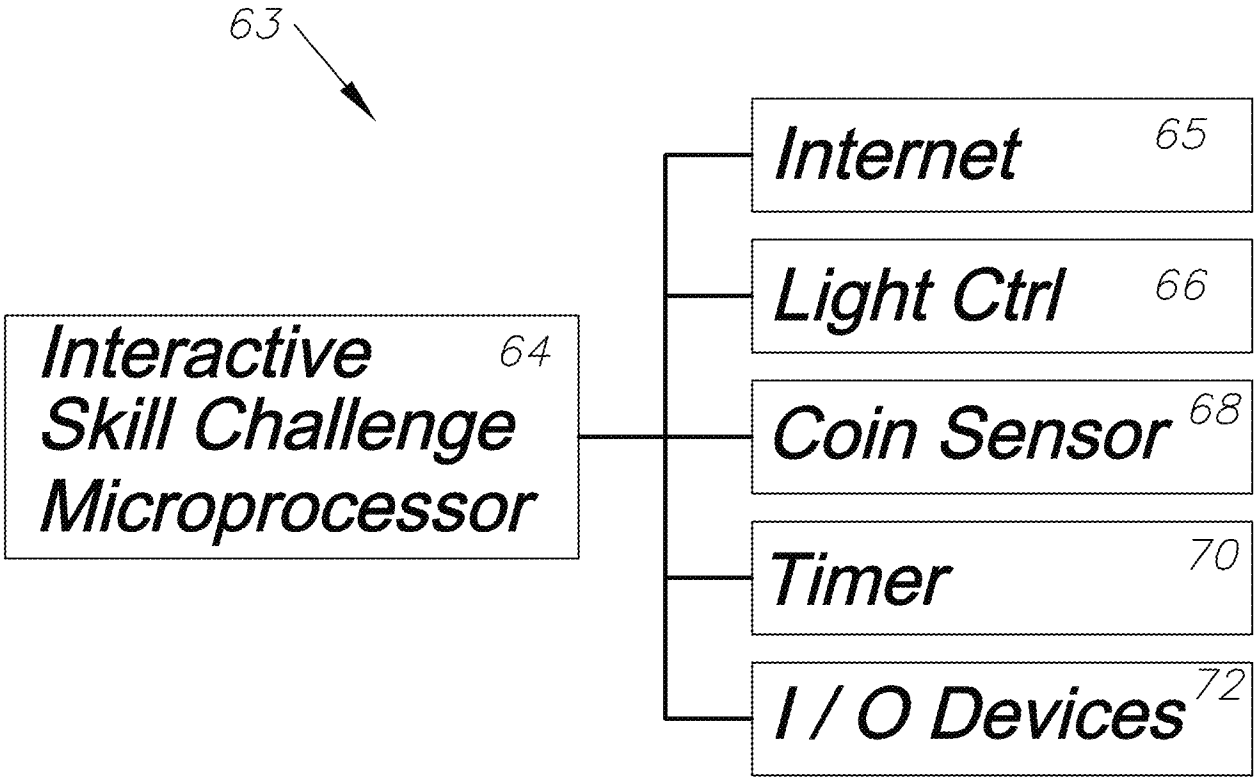
FIG. 10 is a block diagram of a computer-controlled, automated, interactive embodiment of the present invention.

III. Alternative Computer-Controlled, Automated Aspect or Embodiment Coin Funnel Spinning Well FIG. 10 shows a computer-controlled, automated, interactive embodiment or aspect of the present invention, including a control system 63 with a microprocessor 64, which can be connected to the Internet at 65 via the cloud, whereby various information can be collected and transmitted. For example, player scores, coin value totals, usage and other useful information can be monitored, stored and transmitted to centralized operations control. Multiple devices 2 in remote locations can thus be monitored for activity, profitability, etc.

At the player level, timers can be provided for monitoring time-in-play for their respective coins. Multiple players can compete, with the objective of maintaining the coins in a spiral trajectory as long as possible. Such times can be monitored, recorded, and transmitted to other contestants. Moreover, the individual devices 2 can maintain and display "records," e.g., longest time-in-play. The control system 63 also includes light controls 66, which can activate path lights showing the spiral trajectories of the coins. Such light controls 66 can be programmed to periodically illuminate to attract players. A coin sensor subsystem 68 can detect coins being inserted in the coin insert opening 20 and leaving the funnel exit 9. The timer subsystem 70 can provide time-in-play input data into the microprocessor 64. The control system 63 can also include various input/output (I/O) devices 72, such as monitors, screens, keypads, mice, etc.

It is to be understood that the invention can be embodied in various forms and is not to be limited to the examples specifically discussed above. The range of components and configurations which can be utilized in the practice of the present invention is virtually unlimited.

Having thus described the invention, what is claimed as new and desired to be secured by Letters Patent is:

1. A coin funnel spinning well device, which comprises:

an upper section including an observation dome and a coin funnel with a lower discharge;

a lower section;

a midsection suspension system connecting said upper and lower sections and configured for oscillating movements in three dimensions;

said upper section including a coin launch assembly mounted inside said observation dome;

said coin launch assembly including a guide panel with a recess forming a guide edge, sloping generally downwardly;

said observation dome including a coin insert opening located outside of said guide panel and configured for receiving coins inserted in said coin launch assembly;

said coin launch assembly, said observation dome and said coin funnel collectively directing inserted coins on spiral trajectories within said upper section;

an upper midsection suspension panel mounted on a lower end of said upper section;

a lower midsection suspension panel mounted on an upper end of said lower section;

multiple connecting bolts each extending through said panels and configured for accommodating oscillating movements in three dimensions between said panels, multiple helical compression springs positioned between said panels and each receiving a respective connecting bolt;

each said panel including multiple connecting bolt receivers each receiving a respective connecting bolt end;

multiple bushings each including a washer configured for placement on a respective panel and engagement by a respective spring end and a tube connected to the washer and received in a respective connecting bolt receiver; and said bushings comprising a material configured to protect said panels from scratching by said spring ends and abating noise from bolts reciprocating within said receivers.

* * * * *